US011432624B2

(12) United States Patent
Herz-Raverty

(10) Patent No.: US 11,432,624 B2
(45) Date of Patent: Sep. 6, 2022

(54) GAUGE ENHANCER BODY JEWELRY SYSTEM AND METHOD

(71) Applicant: Phoenixx Paislee Herz-Raverty, Riverfalls, WI (US)

(72) Inventor: Phoenixx Paislee Herz-Raverty, Riverfalls, WI (US)

( * ) Notice: Subject to any disclaimer, the term of this patent is extended or adjusted under 35 U.S.C. 154(b) by 324 days.

(21) Appl. No.: 16/844,828

(22) Filed: Apr. 9, 2020

(65) Prior Publication Data

US 2021/0315331 A1 Oct. 14, 2021

(51) Int. Cl.
*A44C 7/00* (2006.01)

(52) U.S. Cl.
CPC ..... *A44C 7/001* (2013.01)

(58) Field of Classification Search
CPC ... A44C 7/00–001; A44C 7/003; A44C 15/00; A44C 15/0005; A44C 15/0035; A44C 15/0045; A61M 29/00
See application file for complete search history.

(56) References Cited

U.S. PATENT DOCUMENTS 6,896,689 B2 * 5/2005 Gedebou ..... A61B 90/02 606/191
8,677,781 B2 * 3/2014 Stoilas ..... A44C 7/001 63/12
8,961,554 B2 * 2/2015 Bettis ..... A44C 7/001 606/198
2007/0179602 A1 * 8/2007 Wright ..... A61M 29/00 606/198
2008/0021496 A1 * 1/2008 Narvaez ..... A44C 7/00 606/198
2011/0107793 A1 * 5/2011 Reynolds ..... A44C 7/00 63/12
2012/0198886 A1 * 8/2012 Stoilas ..... A44C 7/001 63/12
2012/0324949 A1 * 12/2012 Bettis ..... A44C 15/0035 63/12
2017/0105494 A1 * 4/2017 Sencer ..... A44C 15/0035

* cited by examiner

*Primary Examiner* — Tan-Uyen T Ho
*Assistant Examiner* — Charles M Wei
(74) *Attorney, Agent, or Firm* — Runyan Law; Charles Runyan

(57) ABSTRACT

The gauge enhancer body jewelry system allows individuals to increase their earlobes to the size they desire. It eliminates the need to constantly purchase new gauges as earlobes expand. It reduces pain associated with the enlargement process and forcing uncomfortably large gauges into earlobe holes. As designed it decreases the risk of infection from removing and replacing gauges. The present invention saves a considerable amount of time and frustration, and allows individuals to enlarge their earlobes at their own pace.

15 Claims, 5 Drawing Sheets

GAUGE ENHANCER BODY JEWELRY SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of jewelry of existing art and more specifically relates to a gauge enhancer body jewelry system.

RELATED ART

Enlarging the earlobes can be a gratifying yet time-consuming, painful, and expensive process. Not only do individuals have to constantly buy new gauges in bigger sizes, which can be a financial burden, but they also have to frequently remove and replace gauges and stretch out the lobes, which can increase the risk of infection. Additionally, stepping up gauge sizes can be painful when forcing in new gauges. A suitable solution is desired.

U.S. Pub. No. 2017/0105494 to Natalie Sencer relates to an expandable gauge earring plug. The described expandable gauge earring plug includes body piercing stretching device, comprising a coiled casing, a protruding piece at the beginning of the coiled casing, a source of the structure allowing the coiled casing to expand by twisting the end most point of the coiled casing allowing it to expand, and a gripping member attached to the end-most point of the coiled casing to secure and direct the rotational path of said casing to facilitate manual expansion. Users of this device are individuals that wish to modify the opening of their healed body piercing in a safe, convenient, and economical manner. It can be offered by specialty retailers, body piercing and tattoo shops, body jewelry companies, and so forth.

SUMMARY OF THE INVENTION

In view of the foregoing disadvantages inherent in the known jewelry art, the present disclosure provides a novel gauge enhancer body jewelry system. The general purpose of the present disclosure, which will be described subsequently in greater detail, is to provide an effective and efficient means for preparing earlobes for gauges.

A gauge enhancer body jewelry system is disclosed herein, the system comprising: at least one coilable biasing assembly, each at least one coilable biasing assembly having a body with an outer diameter; and an inner diameter; an axle; and at least one biasing member; wherein each coilable biasing assembly comprises the body, the axle and the at least one biasing member in functional combination, the at least one biasing member wrapped about the axle, the axle able to be rotated such that the at least one biasing member is able to expand outwardly in relation and adjacent to a hole in an earlobe such that a diameter of the hole is able to be incrementally enlarged via stretching.

According to another embodiment, a method of use for the gauge enhancer body jewelry system is also disclosed herein, the method comprising the steps of: providing a pair of coilable biasing assemblies; inserting the pair of coilable biasing assemblies into respective holes in earlobes; and rotating an axle such that two biasing members are able to expand outwardly in relation and adjacent to the holes in each earlobe such that a diameter of the hole is able to be incrementally enlarged via stretching. The method may further comprise the step of using a tool to engage the axle to rotate one direction to expand outwardly an outer periphery and turn in another direction to make the outer periphery smaller.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a gauge enhancer body jewelry system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to jewelry and more particularly to a gauge enhancer body jewelry system as used to improve the comfort of increasing hole size for gauges in earlobes.

Generally, gauge enhancer body jewelry provides a safe, convenient, and cost-effective way to enlarge the earlobes. This innovative product may comprise a pair of gauge earrings, made from plastic, metal, or other suitable material, that can expand from a starting position to a large gauge over time. Within the earrings can be coils that expand and retract via a dial on the back. When expanded, the coils cause the gauges to open up. In use, wearers can expand the coils as much or as little as desired, allowing them to enlarge their earlobes, using only one piece of jewelry, at their own pace. The exact specifications may vary upon manufacturing.

Referring now more specifically to the drawings by numerals of reference, there is shown in FIGS. 1-5, various views of a gauge enhancer body jewelry system 100.

Figure 1:
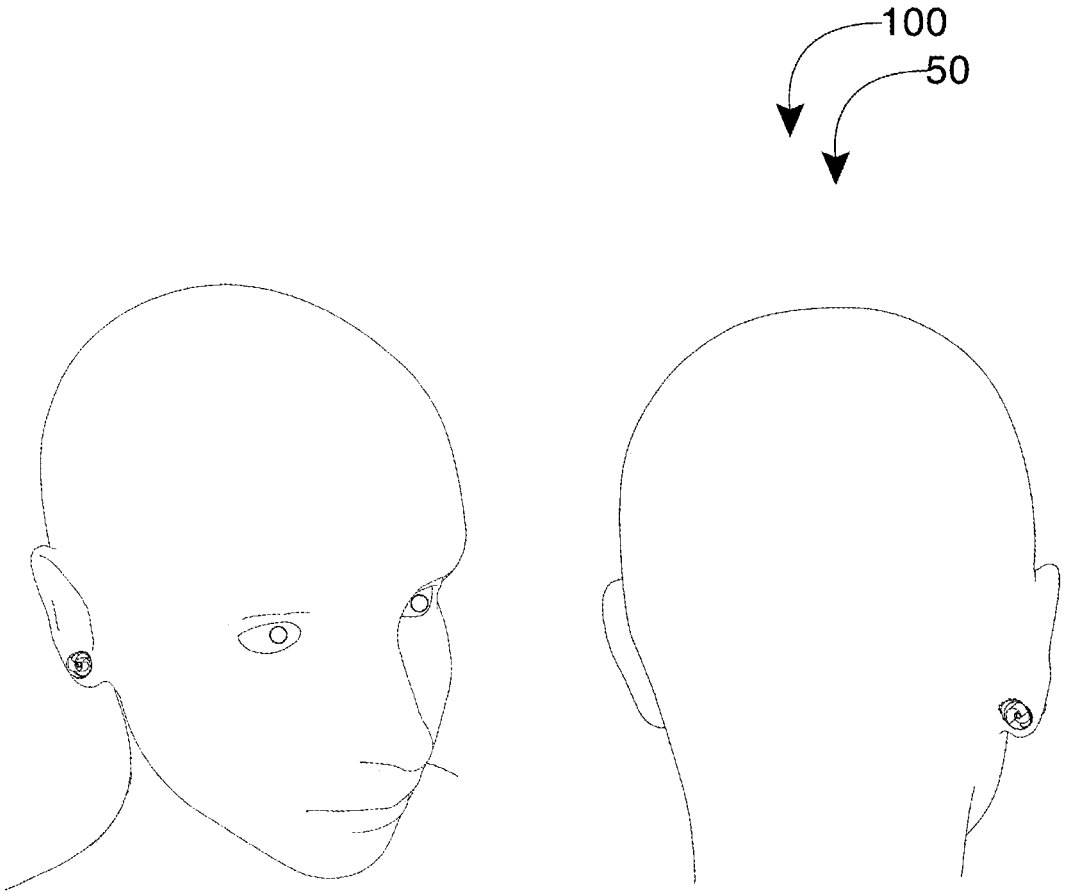
FIG. 1 is a perspective view of the gauge enhancer body jewelry system during an 'in-use' condition, according to an embodiment of the disclosure.
Figure 2:
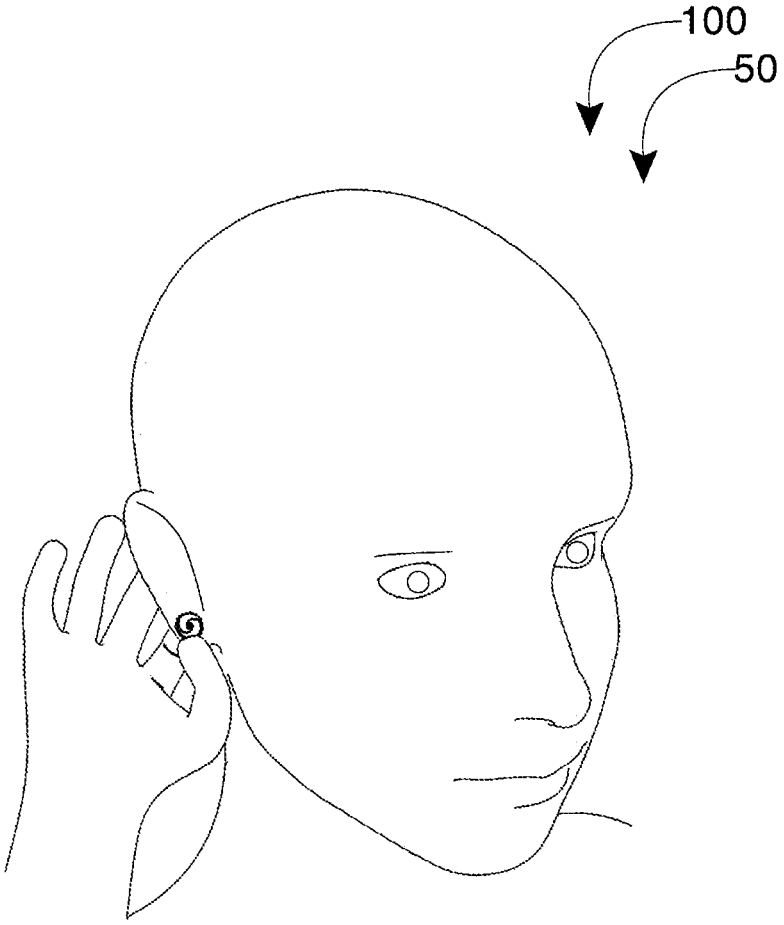
FIG. 2 is a perspective view of the gauge enhancer body jewelry system of FIG. 1, according to an embodiment of the present disclosure.
Figure 3:
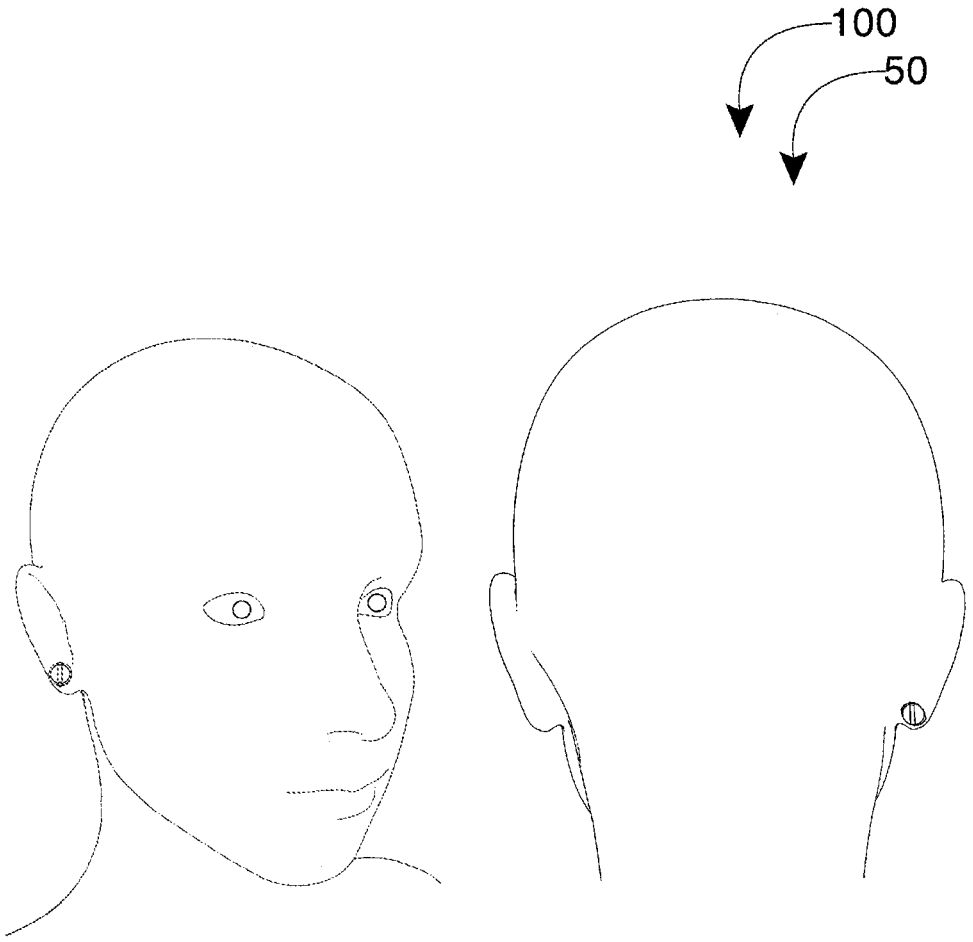
FIG. 3 is a perspective view of the gauge enhancer body jewelry system of FIG. 1, according to an embodiment of the present disclosure.
Figure 4:
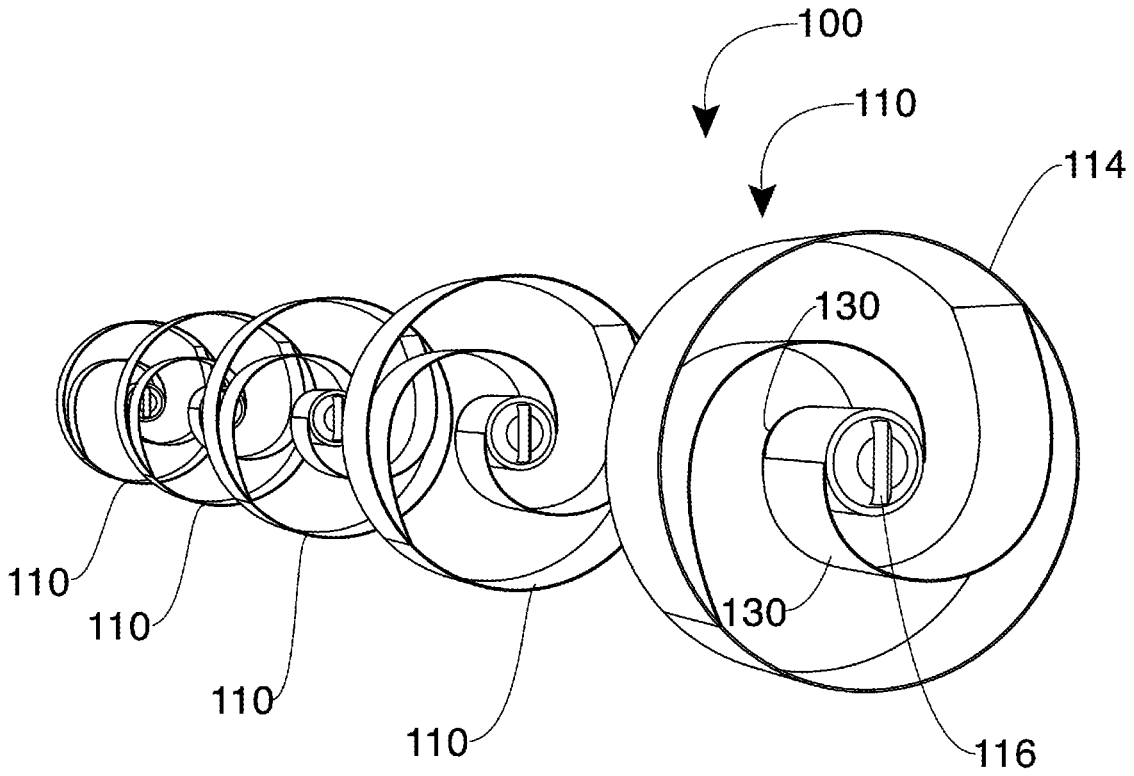
FIG. 4 is a perspective view of the gauge enhancer body jewelry system of FIG. 1, according to an embodiment of the present disclosure.
Figure 5:
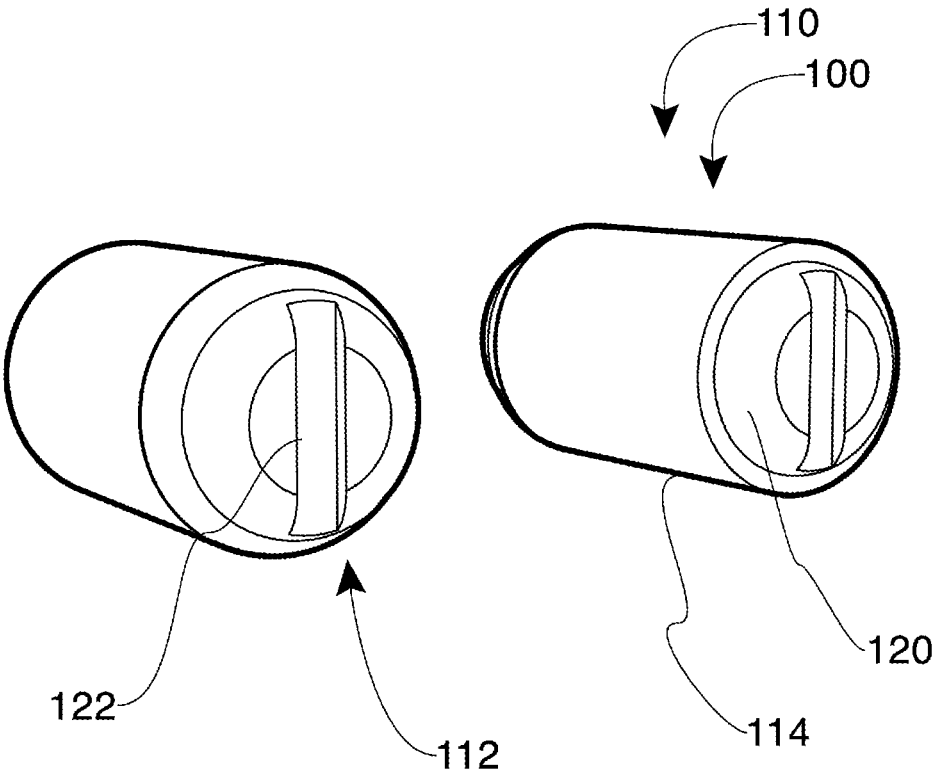
FIG. 5 is a perspective view of the gauge enhancer body jewelry system of FIG. 1, according to an embodiment of the present disclosure.

FIG. 1 shows a gauge enhancer body jewelry system 100 during an 'in-use' condition 50, according to an embodiment of the present disclosure. Here, the gauge enhancer body jewelry system 100 may be beneficial for use by a user to gradually enlarge holes in earlobes for gauges. As illustrated, the gauge enhancer body jewelry system 100 may include at least one coilable biasing assembly 110, each at least one coilable biasing assembly 110 having a body 112 with an outer diameter 114; and an inner diameter 116; an axle 120; and at least one biasing member 130; wherein each coilable biasing assembly 110 comprises the body 112, the axle 120 and the at least one biasing member 130 in functional combination. The at least one biasing member 130 is wrapped about the axle 120; the axle 120 able to be rotated such that the at least one biasing member 130 is able to expand outwardly in relation and adjacent to a hole in an earlobe such that a diameter of the hole is able to be incrementally enlarged via stretching.

According to one embodiment, the gauge enhancer body jewelry system 100 may be arranged as a kit. In particular, the gauge enhancer body jewelry system 100 may further include a set of instructions. The instructions may detail functional relationships in relation to the structure of the gauge enhancer body jewelry system 100 such that the gauge enhancer body jewelry system 100 can be used, maintained, or the like, in a preferred manner.

FIGS. 2-5 shows the gauge enhancer body jewelry system 100 of FIG. 1, according to an embodiment of the present disclosure.

The at least one biasing member 130 preferably comprises exactly two of the at least one biasing members 130, as shown, wherein each of the at least one biasing members 130 are attached to the axle 120. The biasing members 130 bias outwardly in relation to the inner diameter 116 making the outer diameter 114 larger as biased. The axle 120 further preferably comprises a tool receiver 122. The tool receiver 122 may comprise a flathead screwdriver channel or other such suitable engagement/receiver means. The tool is received by the tool receiver 122 and is able to be manipulated in a clockwise or counter-clockwise direction as desired. As such, the tool receiver 122 may comprises a channel slot or a non-channel slot. The axle 120 of the gauge enhancer body jewelry system 100 may comprise a gasket or rubber or suitable material seal.

Referring now again to the biasing members 130; the biasing members 130 are preferably sequentially wrapped about the axle 120; wherein the biasing members 130 preferably comprise spring steel or other suitable non-toxic material able to bias. The biasing members 130 are connected into the outer diameter 114 and in preferred embodiments are integral with the outer diameter 114. The biasing members 130 of the gauge enhancer body jewelry system 100 are normally in tension such that they bias towards the outer diameter 114. Those with ordinary skill in the art will now appreciate that upon reading this specification and by their understanding the art of biasing as described herein, methods, means and materials for biasing will be understood by those knowledgeable in such art. The at least one coilable biasing assembly 110 is preferably made of hypoallergenic material (or other such suitable material) such that human tissue of the earlobes doesn't react unfavorably during use.

The outer diameter 114 is expandable to increase the periphery 115 such that outward pressure is able to be placed on the hole of the earlobe to stretch it gently and gradually as increased; wherein the outer diameter 114 has a flat width to engage with the hole. The biasing members 130 form a roll when brought around the inner diameter 116.

A method of use for the gauge enhancer body jewelry system may comprise the steps of: providing a pair of coilable biasing assemblies; inserting the pair of coilable biasing assemblies into respective holes in earlobes; and rotating an axle such that two biasing members are able to expand outwardly in relation and adjacent to the holes in each earlobe such that a diameter of the hole is able to be incrementally enlarged via stretching. The method may further comprise the step of using a tool to engage the axle to rotate one direction to expand outwardly an outer periphery and turn in another direction to make the outer periphery smaller.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for use of the gauge enhancer body jewelry system, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A gauge enhancer body jewelry system, the system comprising:

at least one coilable biasing assembly, each said at least one coilable biasing assembly having a body with an outer diameter; and an inner diameter;

an axle; and at least one biasing member;

wherein each said coilable biasing assembly comprises the body, the axle and the at least one biasing member in functional combination, the at least one biasing member wrapped about the axle, the axle able to be rotated such that the at least one biasing member is able to expand outwardly in relation and adjacent to a hole in an earlobe such that a diameter of the hole is able to be incrementally enlarged via stretching.

2. The gauge enhancer body jewelry system of claim 1, wherein the at least one biasing member comprises exactly two of the at least one biasing members.

3. The gauge enhancer body jewelry system of claim 2, wherein each of the at least one biasing members are attached to the axle.

4. The gauge enhancer body jewelry system of claim 3, wherein the at least one biasing members bias outwardly in relation to the inner diameter making the outer diameter larger as biased.

5. The gauge enhancer body jewelry system of claim 1, wherein the axle further comprises a tool receiver.

6. The gauge enhancer body jewelry system of claim 5, wherein the tool receiver comprises a channel slot.

7. The gauge enhancer body jewelry system of claim 6, wherein the axle comprises a gasket.

8. The gauge enhancer body jewelry system of claim 7, wherein the at least one biasing members comprise spring steel.

9. The gauge enhancer body jewelry system of claim 8, wherein the at least one biasing members connect into the outer diameter.

10. The gauge enhancer body jewelry system of claim 1, wherein the at least one biasing members are normally in tension.

11. The gauge enhancer body jewelry system of claim 10, wherein the at least one coilable biasing assembly is made of hypoallergenic material.

12. The gauge enhancer body jewelry system of claim 11, wherein the outer diameter is expandable to increase a periphery.

13. The gauge enhancer body jewelry system of claim 1, wherein the at least one biasing members form a roll.

14. A gauge enhancer body jewelry system, the system comprising:

at least one coilable biasing assembly, each said at least one coilable biasing assembly having a body with an outer diameter; and an inner diameter;

an axle; and exactly two biasing members;

wherein each said coilable biasing assembly comprises the body, the axle and the at least two biasing members are in functional combination, the two biasing members wrapped about the axle, the axle able to be rotated such that the biasing members are able to expand outwardly in relation and adjacent to a hole in an earlobe such that a diameter of the hole is able to be incrementally enlarged via stretching;

wherein the biasing members are spring steel and bias outwardly in relation to the inner diameter making the outer diameter larger as biased;

wherein the axle further comprises a tool receiver; and wherein the tool receiver comprises a channel slot.

15. The gauge enhancer body jewelry system of claim 14, further comprising a set of instructions; and wherein the gauge enhancer body jewelry system is arranged as a kit.

* * * * *